United States Patent [19]

Samarin

[11] 3,950,869

[45] Apr. 20, 1976

[54] STRETCHER FRAME

[76] Inventor: John Jacob Samarin, 7273 Adkins Road, Mentor, Ohio 44060

[22] Filed: July 30, 1975

[21] Appl. No.: 600,395

[52] U.S. Cl. ..... 38/102.91; 160/395; 160/378

[51] Int. Cl.[2] ..... D06C 3/08

[58] Field of Search ..... 160/371, 373, 374.1, 160/375, 377, 378, 382, 391, 395, 399, 402; 101/127.1, 127; 38/102, 102.1, 102.4, 102.9, 102.91

[56] References Cited

UNITED STATES PATENTS

| | | | |
|---|---|---|---|
| 3,127,695 | 4/1964 | Driscoll et al. | 160/378 |
| 3,180,220 | 4/1965 | Jeffree | 160/378 |
| 3,529,653 | 9/1970 | Fey | 160/374.1 |

*Primary Examiner*—G. V. Larkin
*Attorney, Agent, or Firm*—Sughrue, Rothwell, Mion, Zinn & Macpeak

[57] ABSTRACT

A device for stretching or sizing canvas or like fabrics has a frame with detachable side and end portions. At least one side and one end portion are provided with beads in which levers are pivotally journaled. The opposite side and end portions having gripping means for the material to be stretched. The material is engaged on the opposite side and end portions by said gripping means, and the levers are depressed and engaged with temporary holding means during the stretching process.

4 Claims, 10 Drawing Figures

FIG. 5
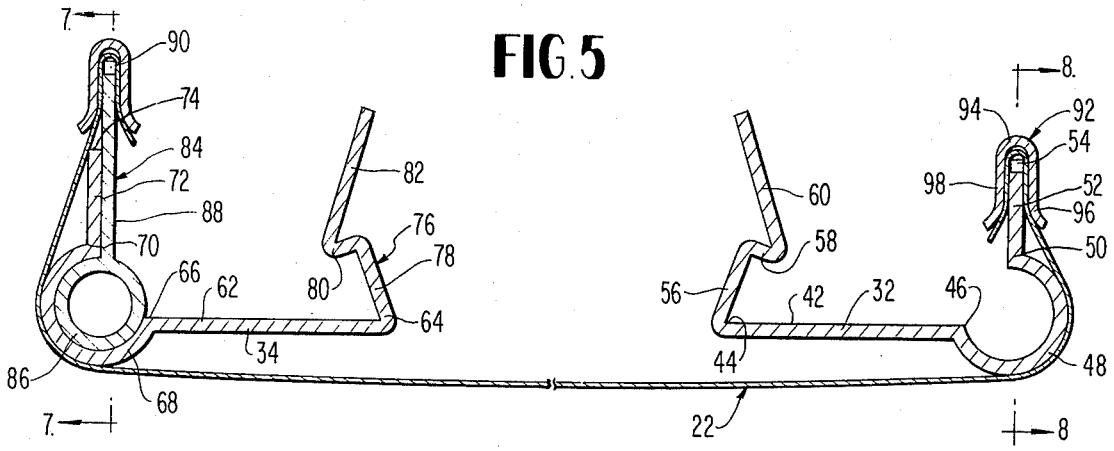
FIG. 6
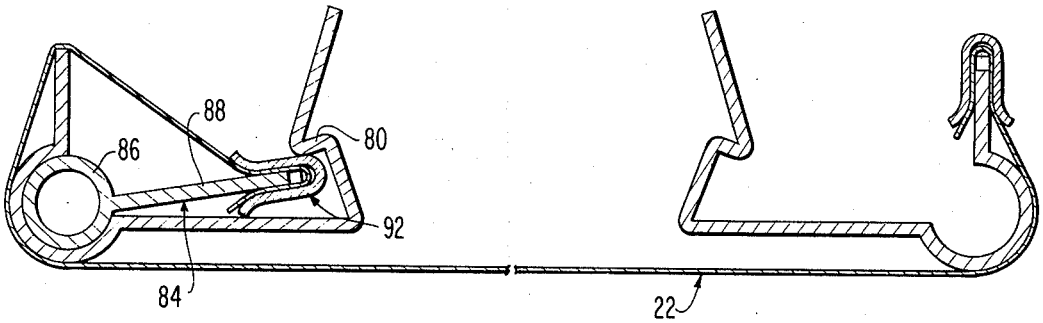
FIG. 7
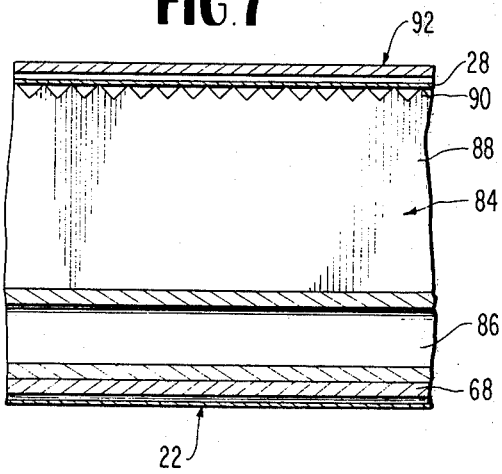
FIG. 8
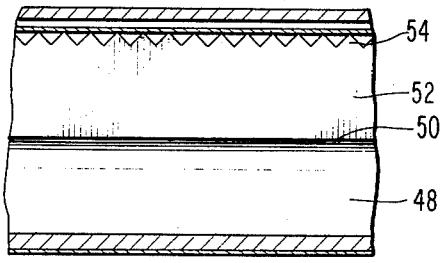
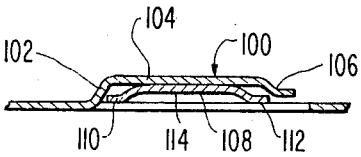
FIG. 10

STRETCHER FRAME

BACKGROUND OF THE INVENTION

1. Field of the Invention

This invention relates to a stretching or sizing device as employed by artists, painters, cloth workers, designers and others, in connection with drawing taut materials such as canvas, silk, linen or the like.

2. Statement of the Prior Art

Stretcher frames for fabrics have been the subject of numerous prior patents. Among these are the below listed United States Patents:

| Patent No. | Patentee | Issued |
|---|---|---|
| 2,498,716 | Seide | Feb. 28, 1950 |
| 3,127,695 | Driscoll et al. | Apl. 7, 1964 |
| 3,180,220 | Jeffreee | Apl. 27, 1965 |
| 3,469,695 | Greeninger | Sept. 30, 1969 |

SUMMARY OF THE INVENTION

The present invention provides a convenient and inexpensive tool for sizing or stretching fabrics which performs its intended function in improved fashion. The apparatus is uniquely suited to its principal function for several reasons. Among these are the lack of necessity for the use of ancillary holding materials such as tacks, nails or adhesives which tend to damage the material during the stretching process. Further, this apparatus obviates the necessity for additional tools or accessories as are required in many prior art devices for this purpose.

The present device provides for the application of a variable tension or degree of stretch, accomplished without the need for pegs or wedges. Additionally, the material is readily releasable after application of the device thereto whereby it may be further stretched or otherwise treated.

The size of the frame provided hereby remains constant despite the degree of force applied, whereby uniformity of stretch is achieved.

The frame is manufactured from metal, plastic, or the like, and is not subject to warpage, shrinking or other problems encountered with wooden frames.

Other and further objects and advantages of the invention will become apparent to those skilled in the art from a consideration of the following specification when read in conjunction with the annexed drawings.

BRIEF DESCRIPTION OF THE DRAWINGS

FIG. 5 is an enlarged scale, foreshortened sectional view on line 5 — 5 of FIG. 1;

FIG. 6 illustrates the unit as in FIG. 5, but at a later stage in the stretching procedure;

FIG. 7 is a sectional view on line 7 — 7 of FIG. 5, looking in the direction of the arrows;

FIG. 8 is a cross section on line 8 — 8 of FIG. 5, looking in the direction of the arrows;

FIG. 10 is a cross-sectional view on line 10 — 10 of FIG. 9, looking in the direction of the arrows and on enlarged scale.

DESCRIPTION OF THE PREFERRED EMBODIMENT

Figure 1:
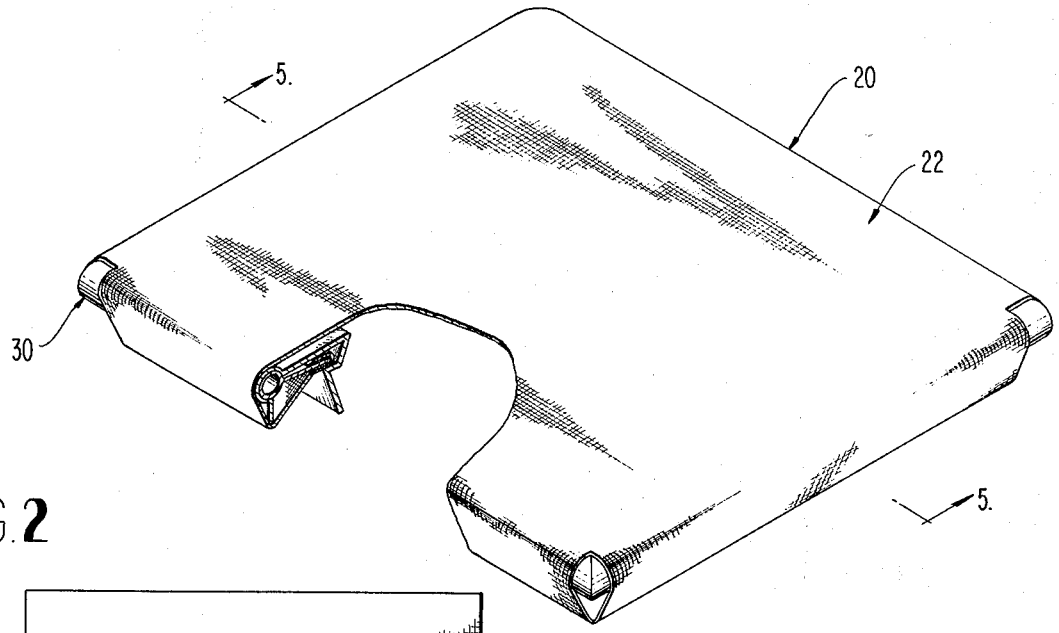
FIG. 1 is a perspective view of a stretcher frame of this invention in use, partially broken away for disclosure of details.
Figure 2:
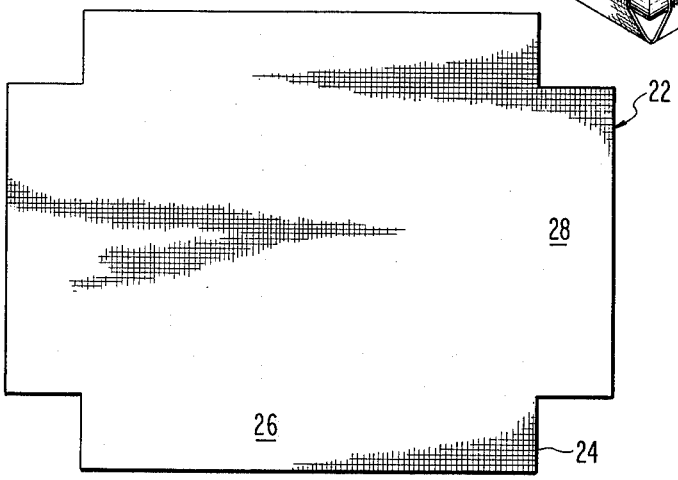
FIG. 2 is a reduced scale top plan view of the material as prepared for stretching.

Referring to the drawings in more detail, a fabric stretcher according to this invention is therein shown and designated generally by reference character 20. The device is adapted for sizing and/or stretching of canvas and other fabrics, such as a generally rectangular section 22 thereof, shown preparatory to use of the invention in FIG. 2. The section of fabric is prepared for stretching by the formation of corner cut-outs 24 at each of its four corners. When so formed, the fabric section has side end edge portions 26 and 28, respectively. This section of fabric is positioned on a flat surface as shown preparatory to utilization of the invention.

The stretching device 20 comprises a substantially rectangular stretcher frame 30 having detachable side and end frame sections, all formed preferably of metal or similar material. These side and end frame sections are each of two types. One of the side frame sections and one end frame section constitute gripper frame sections 32, while the respective opposite side and end frame sections serve as stretcher frame sections 34. The sectional views designated as FIGS. 5 and 6 of the drawing illustrate end frame sections, but the description of side frame sections is identical thereto and hence is not repeated.

Figure 9:
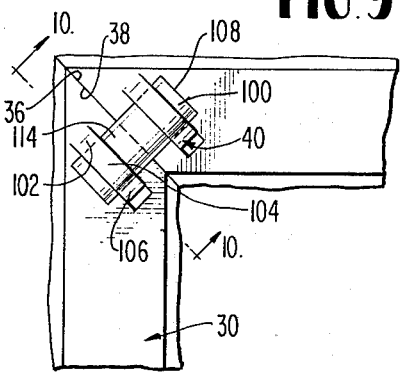
FIG. 9 is a fragmentary bottom plan view of a corner connection means hereof.

The respective side and end frame sections are detachably joined in rectangular fashion at abutting mitered edges 36 and 38 as shown in FIG. 9. At each of these corner means 40 is provided to detachably join the frame sections together, such means being described in more detail below.

Each of the gripper frame portions comprises a substantially flat main body 42 having an inner edge 44 and an outer edge 46. A rounded, downwardly and outwardly extended bead 48 extends integrally from the outer edge of the main body, and the bead has a remote terminal edge 50. From the latter, a vertical wall 52 extends, terminating in a serrated or toothed top 54.

For ease of handling and economy of manufacture, the inside of the gripper frame sections are the same as that of the stretcher frame sections, as appears below. Thus, a slant wall 56 extends from the inner edge 44 of the main body toward the bead, and is connected by a bridge 58 to a reverted handle 60.

The stretcher frame portions 34 each have a flat base 62 with an inside edge 64 and an outside edge 66. A rounded, downwardly and outwardly extended stretcher bead 68 projects from the outside edge 66 and has a terminal bead edge 70. A vertical stretcher wall 72, having a smooth top 74, extends vertically from said bead edge.

The inside of the stretcher frame sections constitute a lock wall 76. The lock walls 76 include a first angular section 78 extending toward the vertical stretcher wall, a downwardly inclinded lip 80, and an upward release wall 82.

An important feature of the invention resides in the provision of a rotor 84 for each stretcher frame portion. The rotors 84 each comprise a tubular base 86 which is dimensioned to fit pivotally within the stretcher bead, and a radially positioned lever wall 88 with a notched or serrated outer end edge 90. It will be observed in FIG. 5 that the lever wall 88 is of a height substantially greater than the height of the vertical stretcher wall 72.

The invention further provides a plurality of fabric clips 92, one of such clips being supplied for each lever wall and each vertical wall of the gripper frames. The clips are U-form and of spring material, and each includes a bight portion 94 and clip arms 96, 98. As shown in the drawing, the arms are outwardly bent at their extremities for ease of removal of the clips.

The means 40 for connection of the frame corners are shown in FIGS. 9 and 10. Each of the sections 32, 34 is provided, on its main body 42 or flat base 62, with an upwardly struck spring clip 100 comprising an angular step 102, a plate 104 and an outer foot member 106. In FIG. 9, it is shown that the clips 100 of adjacent sections are co-aligned and substantially parallel to one another and to the mitered edges 36 and 38. A connector body 108 has legs 110, 112 at its side and an elevated main extent 114 and is of a length sufficient to span the distance between the adjacent clips. It is also of a height to frictionally engage the clips and to thereby connect the frame sections to one another.

Figure 3:
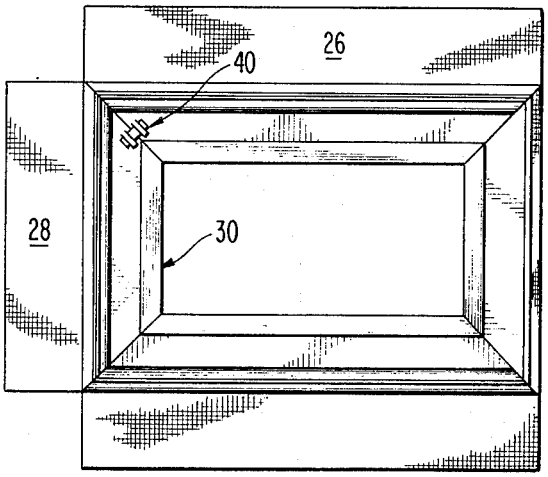
FIG. 3 is a bottom plan view showing a step in application of the fabric to the frame.
Figure 4:
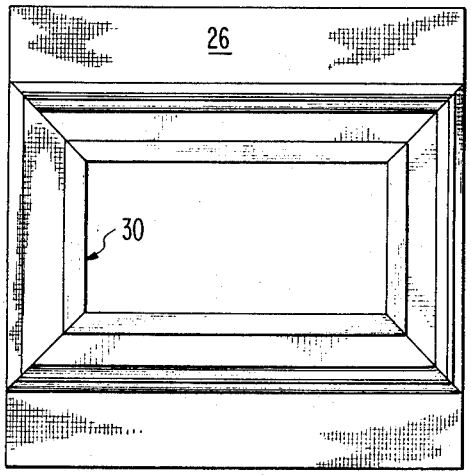
FIG. 4 is a view like FIG. 3 showing a next step in that procedure.

In use, the fabric section 22 is prepared as aforesaid. The frame 30 is then positioned on the fabric in the manner shown in FIGS. 3 and 4. An end edge 28 of the fabric is wrapped about the bead 48 and over the serrated top 54 of the vertical wall 52, whereat it is engaged by a clip 92. The opposite end edge of the fabric is then extended over the serrated outer end edge 90 of the lever wall 88, the lever wall being in the vertical position of FIG. 5. A clip 92 secures the fabric in that position. Referring to FIG. 6, the lever is then manually depressed in a clockwise direction stretching the fabric in one direction. This continues until the clip 92 on the lever engages under the lip 80 thereby locking it in place. This procedure is then repeated by use of the side frames. Release following stretching is accomplished by applying an inboard pressure to the release wall 82 which disengages the clip 92 from under the lip 80.

The material 22 is preferably arranged on the frame such that the warp or filling thereof is substantially parallel to the frame section to provide maximum uniformity of stretch.

I claim:

1. A stretching device for fabric, the fabric having corner cut-outs providing side edge portions and end edge portions, the stretching device comprising:

a substantially rectangular stretcher frame having detachable side and end frame portions;

one of said side frame portions and one of said end frame portions constituting gripper frame portions, and the other of said side and end frames constituting stretcher frame portions;

the respective frame portions having abutting mitered edges;

means releasably securing the respective frame sections to one another at said mitered edges;

the gripper frame portions each comprising a substantially flat main body having an inner edge and an outer edge, around it, outwardly and downwardly extended gripper bead extending from the outer edge and having a terminal edge, a vertical wall with a serrated top projecting from the terminal edge, a slant wall extending upwardly and toward the bead from the inner edge, and a reverted handle on said slant wall;

the stretcher frame portions each comprising a substantially flat base having inside and outside edges, a rounded, outwardly and downwardly extended stretcher bead projecting from the outside edge and having a bead edge, a vertical stretcher wall with a smooth top extending from the bead edge, and an inside lock wall on the inside edge;

the lock walls of the stretcher frames each comprising a first angular section extending toward the stretcher wall, a downwardly inclined lip, and an upward release wall;

the stretcher frame portions each further including a rotor having an elongated tubular base pivotally positioned in the stretcher bead, and a radially projecting lever wall with a serrated outer end edge;

the lever walls extending substantially above the vertical stretcher wall;

fabric clips having clip arms engageable over the serrated tops of the vertical walls of the gripper frame portions, and over the serrated outer end edges of the rotors;

the fabric side and end edge portions being folded over said serrated tops and serrated outer end edges and maintained thereon by said fabric clips, the clips being engaged over the side and end edge portions of the fabric and over the said tops and outer end edges; and the levers being pivotal with the clips and fabric portions from vertical connection locations to depressed stretching positions, and the clips thereof being engageable under the lips of the lock walls.

2. The invention of claim 1 wherein:

the means releasably securing the frame sections to one another comprise a spring clip on adjacent gripper frame main bodies and stretcher frame flat bases;

the spring clips of adjacent mitered edges being co-aligned and mutually substantially parallel; and a connector body engaged under each of the spring clips.

3. A stretching device for fabric comprising:

a substantially rectangular stretcher frame having frame side and end portions;

one of said side frame portions and one of said end frame portions constituting gripper frame portions, and the other of said side and end frames constituting stretcher frame portions;

the gripper frame portions comprising main body portions having outward beads and having vertical walls extending from said beads;

the stretcher frame portions comprising bases with extended stretcher beads and vertical walls;

a rotor pivotally journaled in each of the beads of the stretcher frame portions;

a length of material engaged over said vertical walls of said gripper frame portions and over said levers of said rotors;

clip means engaging the fabric on said vertical walls and on said levers of said rotors; and the levers being pivotal with the clips and fabric portions from vertical connection locations to the pressed stretching positions.

4. The invention of claim 3, and:

lock means on the stretcher frame portions for releasable engagement of said levers and the clips thereof.

* * * * *